US009821478B2

(12) United States Patent
Kleine Doepke et al.

(10) Patent No.: US 9,821,478 B2
(45) Date of Patent: Nov. 21, 2017

(54) SHAVING APPARATUS, A CUTTING UNIT, AND A SHAVING HEAD

(75) Inventors: Bastian Cornelis Kleine Doepke, Drachten (NL); Johan Bron, Drachten (NL); Johan Pragt, Drachten (NL); Hendrik Poel, Glimmen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 615 days.

(21) Appl. No.: 12/602,803

(22) PCT Filed: Jun. 11, 2008

(86) PCT No.: PCT/IB2008/052303

§ 371 (c)(1),
(2), (4) Date: Dec. 3, 2009

(87) PCT Pub. No.: WO2008/152590

PCT Pub. Date: Dec. 18, 2008

(65) Prior Publication Data

US 2010/0175258 A1 Jul. 15, 2010

(30) Foreign Application Priority Data

Jun. 13, 2007 (EP) ..... 07110195

(51) Int. Cl.
*B26B 19/14* (2006.01)
*B26B 19/38* (2006.01)

(52) U.S. Cl.
CPC ..... *B26B 19/143* (2013.01); *B26B 19/384* (2013.01)

(58) Field of Classification Search
CPC ..... B26B 19/14; B26B 19/143; B26B 19/00; B26B 19/04; B26B 19/06
USPC ..... 30/43.4–43.92; 76/115; D28/50
See application file for complete search history.

(56) References Cited

U.S. PATENT DOCUMENTS

| | | | | |
|---|---|---|---|---|
| 2,217,519 A | | 10/1940 | Meyer | |
| 2,234,891 A | | 3/1941 | Bruecker | |
| 3,116,551 A | * | 1/1964 | Anton | 30/43.6 |
| 3,261,091 A | * | 7/1966 | Van Den Driest | 30/43.6 |
| 3,639,979 A | * | 2/1972 | Zuurveen | 30/43.6 |

(Continued)

FOREIGN PATENT DOCUMENTS

| | | |
|---|---|---|
| DE | 1011319 B | 6/1957 |
| DE | 1111062 | 7/1961 |

(Continued)

*Primary Examiner* — Jason Daniel Prone

(57) ABSTRACT

A shaving apparatus, shaving head and/or at least one cutting unit for shaving both short and long hairs. The shaving apparatus, shaving head and/or at least one cutting unit includes an external cutting member and an internal cutting member movably arranged with respect to the external cutting member. A driver may be provided for moving the internal cutting member. The external cutting member is provided with a shaving section having two mutually connected lateral borders forming hair entry apertures. The internal cutting member is provided with cutting elements having cutting edges for cooperation with cutting edges of the external cutting member. A number of the hair entry apertures are formed by two substantially flat lamellae of the external cutting member which have free ends positioned between the borders of the shaving section.

17 Claims, 3 Drawing Sheets

(56) References Cited

U.S. PATENT DOCUMENTS

| | | | | | |
|---|---|---|---|---|---|
| 3,648,367 | A | * | 3/1972 | Tolmie | 30/43.6 |
| D237,319 | S | * | 10/1975 | Sakai et al. | D28/50 |
| 4,081,902 | A | | 4/1978 | Locke | |
| 4,102,044 | A | * | 7/1978 | Rookus | 30/43.92 |
| 4,180,906 | A | | 1/1980 | May | |
| 4,393,586 | A | * | 7/1983 | Hamashima et al. | 30/43.6 |
| 4,635,360 | A | * | 1/1987 | Tanahashi et al. | 30/43.6 |
| D355,277 | S | * | 2/1995 | Uchiyama et al. | D28/50 |
| D355,505 | S | * | 2/1995 | Uchiyama et al. | D28/50 |
| 5,427,001 | A | * | 6/1995 | Uchiyama et al. | 76/115 |
| 5,669,138 | A | * | 9/1997 | Wetzel | 30/43.6 |
| 5,692,303 | A | | 12/1997 | Garenfeld et al. | |
| D469,219 | S | * | 1/2003 | McLachlan | D28/50 |
| 6,868,611 | B2 | * | 3/2005 | Geertsma et al. | 30/43.6 |
| D520,681 | S | * | 5/2006 | Beedham | D28/50 |
| 7,269,902 | B2 | * | 9/2007 | Van Der Meer | 30/43.6 |
| 8,037,613 | B2 | * | 10/2011 | Everett et al. | 30/43.6 |
| 8,151,467 | B2 | * | 4/2012 | Wllem et al. | 30/43.6 |
| D758,659 | S | * | 6/2016 | Smith | D28/50 |
| D776,348 | S | * | 1/2017 | Frankel | D28/50 |
| 2001/0039734 | A1 | * | 11/2001 | Kadijk et al. | 30/43.6 |
| 2003/0070304 | A1 | * | 4/2003 | Curello | 30/346.51 |
| 2008/0072429 | A1 | * | 3/2008 | Uchiyama | 30/43.6 |
| 2009/0025228 | A1 | * | 1/2009 | Minkes et al. | 30/43.6 |
| 2010/0139098 | A1 | * | 6/2010 | Kuijper et al. | 30/45 |
| 2012/0110854 | A1 | * | 5/2012 | Nakano et al. | 30/43.5 |
| 2016/0089799 | A1 | * | 3/2016 | Mimura | B26B 19/143 30/43.6 |

FOREIGN PATENT DOCUMENTS

| | | | | | |
|---|---|---|---|---|---|
| JP | 2006247146 | A | | 9/2006 | |
| NL | WO 0245920 | A1 | * | 6/2002 | B26B 19/143 |
| NL | WO 2008152590 | A1 | * | 12/2008 | B26B 19/143 |
| NL | EP 2158067 | B1 | * | 5/2013 | B26B 19/143 |
| WO | 9423913 | A1 | | 10/1994 | |
| WO | 2004108368 | A1 | | 12/2004 | |

* cited by examiner

SHAVING APPARATUS, A CUTTING UNIT, AND A SHAVING HEAD

FIELD OF THE INVENTION

The invention relates to a shaving apparatus having at least one cutting unit, which cutting unit comprises an external cutting member and an internal cutting member movably arranged with respect to the external cutting member, and having a driver for moving the internal cutting member, wherein the external cutting member is provided with a shaving section having two interconnected lateral borders between which hair entry apertures with cutting edges are provided, and the internal cutting member is provided with cutting elements having cutting edges for cooperation with said cutting edges of the external cutting member. The invention further relates to a cutting unit suitable for use in the shaving apparatus and to a shaving head provided with one or more cutting units.

BACKGROUND OF THE INVENTION

Shaving apparatus of the kind indicated above are widely known and e.g. disclosed in WO-A 2004/108368. The apparatus disclosed in said publication has three cutting units, also known as shaving heads, which are provided in a skin contact surface. Each cutting unit comprises one annular shaving portion formed by an external cutting member provided with hair trapping apertures and a rotatably arranged internal cutting member having a number of knives for cutting hair protruding through said hair trapping apertures. The hair trapping apertures are constituted by axially and radially extending slits formed in an annular region of the external cutting member by lamellae radially extending from an inner edge of the annular region to an outer edge of the annular region. Although such a configuration of slits and lamellae has proven to function well as a hair catching structure, it has been found that the configuration causes problems in catching rather long hairs. Such hairs are pushed down against the skin by the lamellae during a shaving movement, as a result of which these rather long hairs cannot enter the slits. Similar shaving apparatus which are provided with two or three annular shaving portions are also known.

SUMMARY OF THE INVENTION

It is an object of the invention to provide a shaving apparatus which is better capable of shaving both short and rather long hairs.

This object is achieved by the shaving apparatus according to the invention as defined in claim 1.

The shaving apparatus according to the invention has at least one cutting unit, which cutting unit comprises an external cutting member and an internal cutting member movably arranged with respect to the external cutting member, and it has a driver for moving the internal cutting member, the external cutting member being provided with a shaving section having two interconnected lateral borders between which hair entry apertures with cutting edges are provided, and the internal cutting member being provided with a cutting element having a cutting edge for cooperation with said cutting edges of the external cutting member, at least a number of said hair entry apertures being formed by laterally open recesses each extending between two substantially flat lamellae of the external cutting member, at least one of these two lamellae having a free end which is positioned between the lateral borders of the shaving section. Usually, the internal cutting member is provided with more than one cutting element. De facto, the cooperating cutting edges of the internal and external cutting members form a cutter in the shaving section of the shaving apparatus. Preferably, both lamellae of said two substantially flat lamellae have free ends positioned between the lateral borders of the shaving section. Such lamellae each have a fixed end and a free end, with the free end not extending beyond the borders. The free ends of the lamellae are able, during use of the shaving apparatus, to scrape long hairs and/or hairs lying flat on the skin to be shaved and to bring these hairs in an improved orientation with respect to the hair entry apertures during a shaving movement. Due to the specific position of the free ends, a hair will enter, highly probably in its well-oriented position, a hair entry aperture and then be cut by cooperating cutting edges. An essential characteristic of the applied measure is that during shaving movements a longer hair is caught and brought into or maintained in a good orientation for cutting at a short distance from cooperating cutting edges.

In a practical embodiment at least one of the lateral borders is constituted by an edge connected to the other lateral border by connection elements. If both borders are constituted by edges they are mutually connected by connection elements. The edges may be shaped in various ways and may be end portions or partitions.

In a preferred embodiment the connection elements comprise connection lamellae, of which one end is connected to one of the borders and the other end is connected to the other border. Preferably these lamellae are substantially flat. The connection lamellae mainly serve for ensuring mechanical stability of the construction.

Another preferred embodiment of the shaving apparatus according to the invention is characterized in that the internal cutting member is rotatably mounted relative to the external cutting member, and the shaving section is an annular section and the lamellae extend substantially radially. In this embodiment the free ends of the lamellae do not extend beyond the contour defined by the annular section and are in the direct vicinity of the cutter.

In the types of shavers having a rotatable cutting member the cutting unit or units are moved along the skin in rotating movements during the shaving process. It has been found that the applied measures of the invention are very effective notably in those shaving movements. During a rotating shaving movement the hairs do not always approach the entry apertures in the right direction, so that the risk exists that such a hair is pushed down by the cutting unit. This phenomenon can be largely prevented if the hairs are caught very shortly before cutting. The invention offers this opportunity because the distance between the free ends of the lamellae and the cutting area is minimal, so that the hairs are caught in the direct vicinity of the cutter during shaving movements. It is to be noted that the lengths of the lamellae having free ends, as such, is of lesser importance, however the position of their free ends, as explained above, with regard to cooperating cutting edges, also called the cutter track, is essential. The distance between a free end and this cutter track is preferably smaller than 400 μm.

In a practical embodiment of the shaving apparatus according to the invention the laterally open recesses are one-sided open slots. In such an embodiment the external cutting member is in general a cup-shaped body. Connection lamellae can be used to control the skin pressure.

In another preferred embodiment of the shaving apparatus according to the invention at least two concentrically arranged shaving sections are provided. Preferably, at least two concentrically arranged shaving sections are provided, a number of hair entry apertures of at least one shaving section being formed by inwardly open recesses, each extending between two substantially flat lamellae of the external cutting member, said lamellae having free inwardly directed ends, and a number of hair entry apertures of at least one other shaving section being formed by outwardly open recesses each extending between two substantially flat lamellae of the external cutting member, said lamellae having free outwardly directed ends. The lamellae of one of the two shaving sections may be radially inwardly directed and the lamellae of the other shaving section may be radially outwardly directed.

Another preferred embodiment of the shaving apparatus according to the invention is characterized in that a set of open recesses is formed by inwardly open recesses each extending between two substantially flat lamellae of the external cutting member, which lamellae have free inwardly directed ends, and a set of open recesses is formed by outwardly open recesses each extending between two substantially flat lamellae of the external cutting member, which lamellae have free outwardly directed ends.

The open recesses may be combined with all-sided closed hair entry apertures. The all-sided closed hair entry apertures may be arranged in a zone around a zone of open recesses, of which recesses the radially extending lamellae are inwardly directed lamellae. Alternatively, the open recesses are arranged in a zone around a zone of all-sided closed hair entry apertures, with the radially extending lamellae of the open recesses being outwardly directed lamellae.

In principle various combination are possible. It is also possible to form a shaving section which has laterally open recesses provided only along a part of its circumference. The other part may be formed by known hair entry apertures.

It is to be noted that EP-A 0 693 988 discloses a dry shaving apparatus provided with a shaving head comprising an outer cutter and an inner cutter. The outer cutter, which includes an engaging surface, is formed by a wall element having slots and relatively long bridge members and by an angled wall element disposed in an angled relationship to the first-mentioned wall element. The bridge members have protruding ends, which project freely relative to the angled wall element and which protrude beyond the outer contour of the angled wall element and lie in the plane of the wall element forming the engaging surface. Said protruding ends are relatively long and are meant as hair-feeding means. Although the protruding ends may be able to lift longer hairs, their position with respect to the cooperating cutter faces, more particularly their relatively large distance to the cooperating cutting faces, is such that lifted-up hairs may easily loose their lifted-up position, e.g. by ending up under a protruding end, before they reach the cutter, particularly during rotating shaving movements. Moreover, the protruding ends may feel uncomfortable during shaving due their unfavourable effect on the pressure exerted on the skin.

A cutting unit according to the invention comprises an external cutting member and an internal cutting member movably arranged with respect to the external cutting member, wherein the external cutting member is provided with a shaving section having two mutually connected lateral borders between which hair entry apertures having cutting edges are provided, and the internal cutting member is provided with a cutting element having a cutting edge for cooperation with said cutting edges of the external cutting member, at least a number of said hair entry apertures being formed by laterally open recesses each extending between two substantially flat lamellae of the external cutting member, at least one of these two lamellae having a free end which is positioned between the borders of the shaving section. This cutting unit has effects and advantages similar to those mentioned in the above explanation of the shaving apparatus according to the invention.

Embodiments of the cutting unit according to the invention have been described in the above description of the shaving apparatus according to the invention.

A shaving head holder according to the invention is provided with one or more cutting units, preferably three cutting units, according to the invention.

The invention also relates to a shaving apparatus provided with a housing accommodating a driver and provided with the shaving head according to the invention.

With reference to the Claims it is noted that all possible combinations of features mentioned in the Claims are part of the invention.

BRIEF DESCRIPTION OF THE DRAWINGS

These and other aspects of the invention are apparent from and will be elucidated with reference to the examples described hereinafter and shown in the drawings, wherein.

DETAILED DESCRIPTION

It is noted that all disclosed embodiments are schematically depicted. It is further noted that corresponding components have been given the same reference signs in the description of the depicted embodiments.

Figure 1:
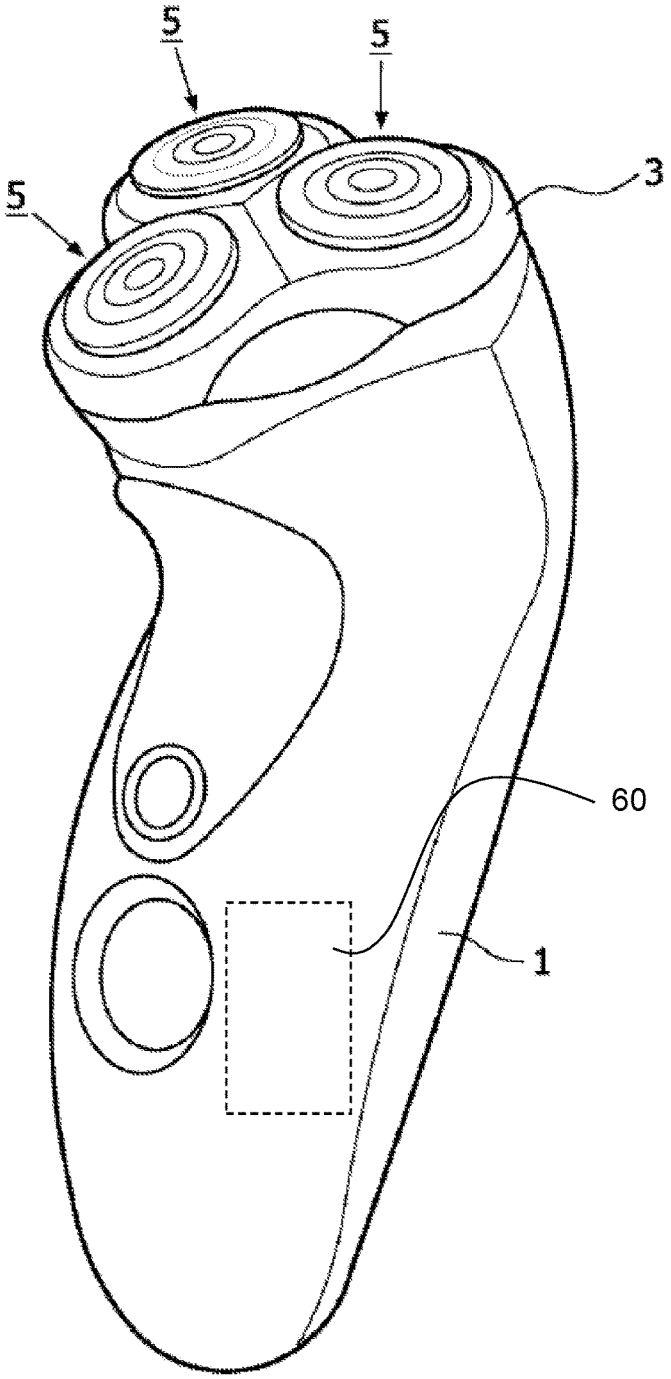
FIG. 1 is a perspective view of an embodiment of the shaving apparatus according to the invention.

The shaving apparatus disclosed in FIG. 1 has a housing 1 provided with a shaving head holder 3 which may be removably or pivotably mounted to the housing 1. In this example three cutting units 5, also denoted shaving heads, are provided in the holder 3.

Figure 2:
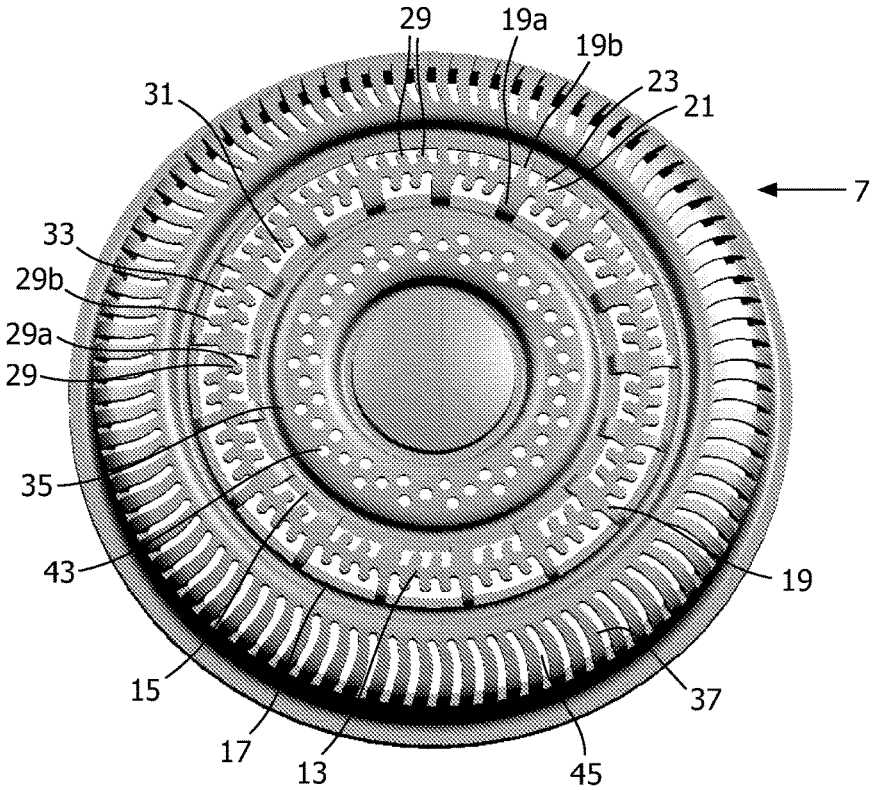
FIG. 2 is a perspective view of an external cutting member of an embodiment of the cutting unit according to the invention.
Figure 3:
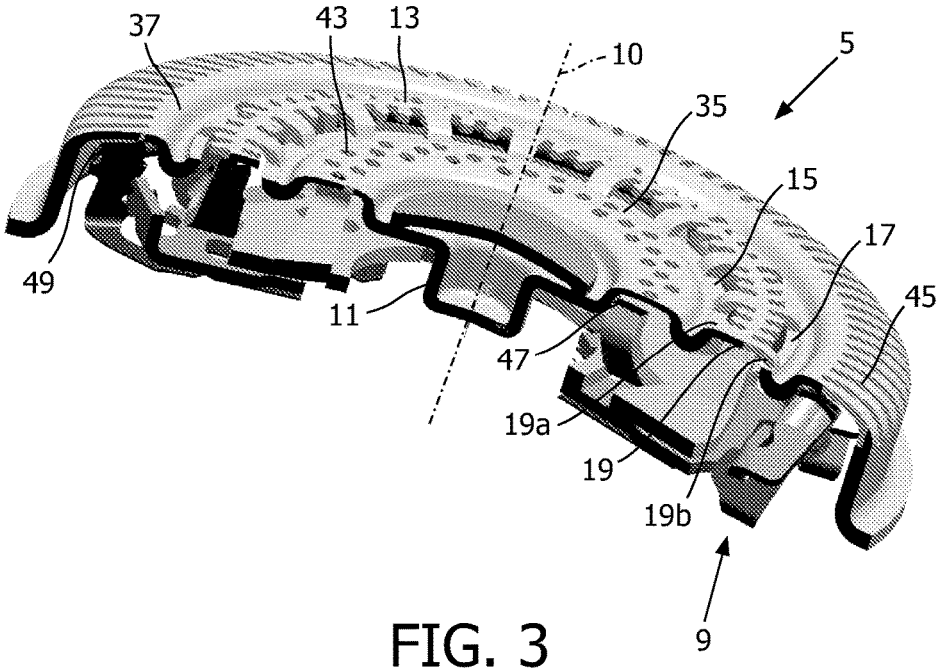
FIG. 3 is a cross-sectional view of the embodiment of the cutting unit mentioned in relation to FIG. 2.
Figure 4:
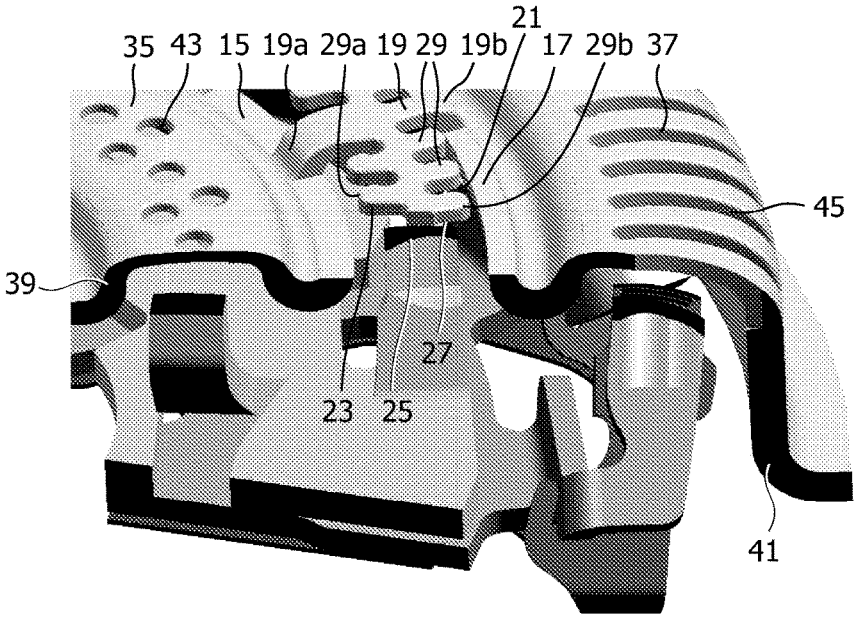
FIG. 4 is a detail of the embodiment of the cutting unit disclosed in FIG. 3.

The cutting unit 5 disclosed in FIGS. 2 to 4 comprises an external cutting member 7 and an internal cutting member 9, which is movably arranged in a shaving head holder for making rotations around an axis 10 with respect to the external cutting member 7. The cutting unit 5 is provided with a driver 11 for rotating the internal cutting member. The driver 11 is connectable to an electrical drive unit accommodated in a housing of a shaving apparatus. Such an electrical drive unit 60 is illustratively depicted in Fig. 1. The external cutting member 7 is provided with an annular shaving section 13 having two concentrically arranged lateral borders 15 and 17. These borders 15 and 17 are connected to each other by connection means, which are formed, in this example, by radially extending lamellae 19, each connection lamella 19 having an end portion 19*a* secured to border 15 and an end portion 19*b* secured to border 17. Many variants of the connection means are possible. De facto the connection lamellae 19 define the width of the shaving section 13, the width being the distance between the borders 15 and 17. The shaving section 13 is provided with hair entry apertures 21 providing cutting edges 23. The internal cutting member 9 is provided with cutting elements 25 having cutting edges 27 for cooperation with the cutting edges 23 of the shaving section 13. The hair entry apertures 21 are radially directed and formed by laterally open recesses, also denoted by numeral 21, of which a number extends between two radially extending lamellae 29 of the external cutting member 7, which lamellae 29 each have a free end which is positioned between the borders 15 and 17 of the shaving section 13. The laterally open recesses have radially directed open ends. Another number of the laterally open recesses 21 extends between a lamella 29 and a connection lamella 19. In both cases the free ends are situated in the shaving section 13 and neither reach nor extend beyond the end portions 19*a*, 19*b* of the connection lamellae 19.

In this example a set 31 of open recesses 21 is formed by inwardly open recesses, the corresponding lamellae 29 having free inwardly directed ends 29*a*, and a set 33 of open recesses 21 is formed by outwardly open recesses, the corresponding lamellae 29 having free outwardly directed ends 29*b*.

In this example the external cutting member 7 has a total of three concentrically arranged shaving sections. Apart from the shaving section 13 discussed above, there are two conventional shaving sections, denoted by the numerals 35 and 37. The innermost section 35 is bordered by an inner border 39 and border 15, while the outermost section 37 is bordered by border 17 and an outer border 41. The shaving sections 35 and 37 are provided with hair entry apertures in the form of round openings 43 and radial slits 45, respectively. The internal cutting member 9 has cutting elements 47 and 49 for cooperation with the shaving sections 35 and 37, respectively.

Figure 5:
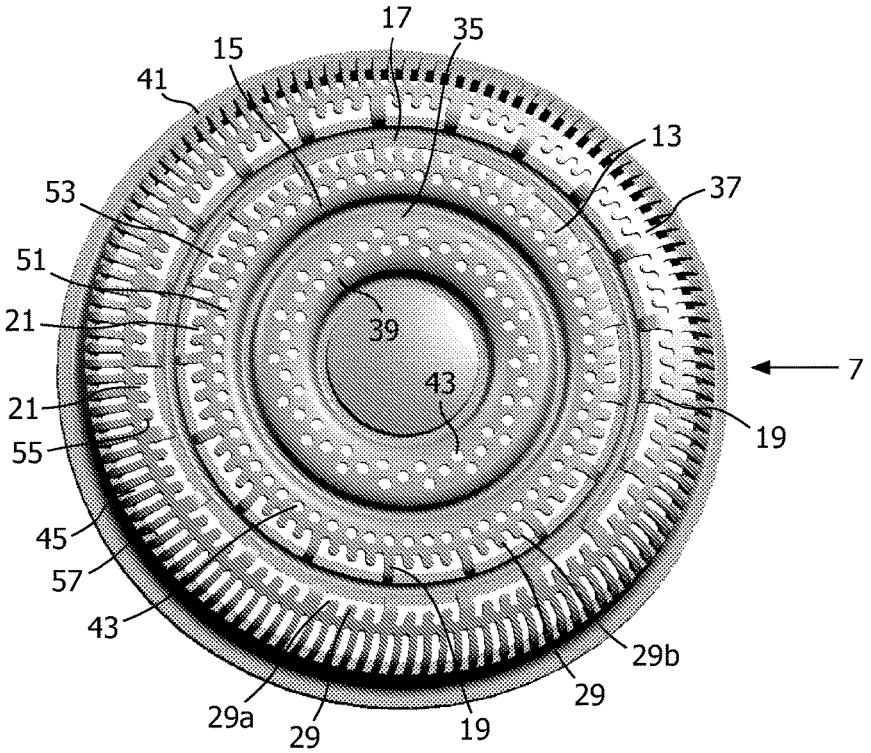
FIG. 5 is a perspective view of an external cutting member of another embodiment of the cutting unit according to the invention.

The external cutting member 7 depicted in FIG. 5 is one of the various alternatives for the external cutting member as depicted in FIG. 2 and also has three concentrically arranged shaving sections, viz. an inner section 35, an intermediate section 13 and an outer section 37. The inner section 35 is defined by lateral borders 39 and 15; the intermediate section 13 is defined by lateral borders 15 and 17, and the outer section 37 is defined by lateral borders 17 and 41. The mentioned pairs of borders 39,15; 15,17 and 17, 41 define the contours of the shaving sections 35, 13 and 37, respectively. The inner shaving section 35 is provided with conventional round hair entry apertures 43. The intermediate shaving section 13 is provided with a ring-shaped zone 51 of conventional round hair entry apertures 43 and a ring-shaped zone 53 of outwardly open recesses 21, which zone 53 extends along the zone 51. The shaving section 13 is provided with radially outwardly extending lamellae 29 having free ends 29*b* positioned within the contours of the section 13. The shaving section 13 is also provided with radially extending connection lamellae 19, which lamellae 19 connect the border 17 to the border 15 via material of the zone 51 or, in other words, indirectly connect the border 17 to the border 15. The outer shaving section 37 is provided with a ring-shaped zone 55 of inwardly open recesses 21 and a ring-shaped zone 57 of conventional slit-shaped hair entry apertures 45, which zone 57 extends along the zone 55. The shaving section 37 is provided with radially inwardly extending lamellae 29 having free ends 29*a* positioned within the contours of the section 37. The shaving section 37 is also provided with radially extending connection lamellae 19, which lamellae 19 connect the border 17 to the border 41 via material of the zone 57.

While the invention has been illustrated and described in detail in the drawings and the foregoing description, said illustration and description are to be considered illustrative or exemplary and not restrictive. The invention is not limited to the disclosed embodiments, for example, it is possible to apply a cutting unit with fewer or more than three shaving sections. Other variations to the disclosed embodiments can be understood and effected by the skilled person in practicing the claimed invention, from a study of the drawings, the description and the claims. Particularly, it is within the scope of the invention to apply the measures taken by the inventor in shaving apparatus which are provided with an internal cutting member which is translatably mounted relative to an external cutting member. In such an apparatus according to the invention, the shaving section usually is an elongated section having a longitudinal axis, wherein the lamellae having free ends of the kind described in the description of the drawings are substantially perpendicularly oriented with respect to the longitudinal axis of the elongated section. Connection lamellae of the kind described in the description of the drawings are preferably used for mechanical reasons and may be used to control the skin pressure.

It is further noted that the apparatus according to the invention and all its components can be made by applying processes and materials known per se. Preferably, the laterally open recesses are formed by electrochemical processing.

In the Claims and the description the word "comprising" does not exclude other elements, and the indefinite article "a" or "an" does not exclude a plurality. Any reference sign in the Claims should not be construed as limiting the scope.

The invention claimed is:

1. A shaving apparatus having at least one cutting unit, the cutting unit comprising:

an annular external cutting member having a central axis and a coaxial shaving section having two concentrically arranged lateral borders, connected together by a plurality of radially extending interconnection portions interconnecting the two borders defining hair entry apertures, with the hair entry apertures further defined by a connecting portion and substantially flat free-end lamellae extending therefrom, the connecting portion extending concentrically around the central axis positioned between the two borders and connected to and between a first and second of the plurality of interconnection portions, the substantially flat free-end lamellae each having a free end extending radially only either inwardly or outwardly from the connecting portion towards and spaced from a corresponding one of the two borders, with only the substantially flat free-end lamellae extending staggered along the connecting portion between the first and second of the plurality of interconnection portions such that the substantially flat free-end lamellae extending outward is radially staggered from the substantially flat free-end lamellae extending inward with the substantially flat free-end lamellae defining cutting edges; and an annular internal cutting member configured to rotate about the central axis with respect to the external cutting member and having a cutting edge configured to cooperate during rotation with the cutting edges of the substantially flat free-end lamellae.

2. The shaving apparatus as claimed in claim 1, comprising all-sided closed hair entry apertures.

3. The shaving apparatus as claimed in claim 1, wherein all-sided closed hair entry apertures are arranged in a shaving section around the coaxial shaving section.

4. The shaving apparatus as claimed in claim 1, wherein the coaxial shaving section is arranged around a shaving section having all-sided closed hair entry apertures.

5. The shaving apparatus as claimed in claim 1, wherein each of the two borders comprises an edge and the plurality of interconnection portions interconnect the edges of the two borders.

6. The shaving apparatus as claimed in claim 5, wherein the plurality of interconnection portions are connection lamellae connecting the two borders to the connecting portion.

7. The shaving apparatus as claimed in claim 1, wherein the shaving section is annular and the two borders, when seen in a direction perpendicular to the central axis, are located at one side of the substantially flat free-end lamellae, which one side of the substantially flat free-end lamellae faces the internal cutting member.

8. The shaving apparatus as claimed in claim 7, further comprising an additional shaving section, wherein the shaving section and the additional shaving section are concentrically arranged around the central axis and with respect to each other.

9. The shaving apparatus as claimed in claim 7, wherein at least some of the hair entry apertures are defined by a plurality of open recesses each extending between two of the free-end lamellae.

10. The shaving apparatus as claimed in claim 1, wherein at least some of the hair entry apertures are defined by laterally open recesses each extending between the substantially flat free-end lamellae, the interconnection portions and the connecting portion, and wherein the laterally open recesses are one-sided open slots.

11. The shaving apparatus as claimed in claim 1, further comprising a driver for moving the internal cutting member and a housing accommodating the driver and supporting the at least one cutting unit.

12. The shaving apparatus as claimed in claim 1, further comprising first and second shaving areas concentrically bordering the two borders, with the first shaving area having a plurality of hair entry apertures in a form of a plurality of round openings arranged around the axis and the second shaving area having a plurality of hair entry apertures in a form of a plurality of radial slits arranged around the central axis.

13. The shaving apparatus as claimed in claim 12, wherein the first shaving area is surrounded by the two borders and the second shaving area surrounds the two borders and the first shaving area.

14. A cutting unit comprising:

an external annular cutting member with a central axis and a coaxial shaving section having two concentrically arranged interconnected lateral borders, and a plurality of radially extending interconnection portions interconnecting the two borders defining hair entry apertures, with the hair entry apertures further defined by a connecting portion and substantially flat free-end lamellae extending therefrom, the connecting portion extending concentrically around the central axis positioned between the two borders and connected to and between first and second of the plurality of interconnection portions, the substantially flat free-end lamellae each having a free end extending radially only either inwardly or outwardly from the connecting portion towards and spaced from a corresponding one of the two borders, with only the substantially flat free-end lamellae extending staggered along the connecting portion between the first and second of the plurality of interconnection portions such that the substantially flat free-end lamellae extending outward is radially staggered from the substantially flat free-end lamellae extending inward with the substantially flat free-end lamellae defining cutting edges; and an annular internal cutting member configured to rotate around the central axis with respect to the external cutting member and having a cutting edge configured to cooperate during rotation with the cutting edges of the substantially flat free-end lamellae.

15. The cutting unit as claimed in claim 14, wherein the external and internal cutting members are concentrically arranged with respect to each other and the two borders, when seen in a direction perpendicular to the central axis, are located at one side of the substantially flat free-end lamellae, which one side of the substantially flat free-end lamellae faces the internal cutting member.

16. A shaving head comprising:

an annular external cutting member with a central axis and a coaxial shaving section having two concentrically arranged interconnected lateral borders, and a plurality of radially extending interconnection portions interconnecting the two borders defining hair entry apertures, with the hair entry apertures further defined by a connecting portion and substantially flat free-end lamellae extending therefrom, the connecting portion extending concentrically around the central axis positioned between the two borders and connected to and between first and second of the plurality of interconnection portions, the substantially flat free-end lamellae each having a free end extending radially only either inwardly or outwardly from the connecting portion towards and spaced from a corresponding one of the two borders, with only the substantially flat free-end lamellae extending staggered along the connecting portion between the first and second of the plurality of interconnection portions such that the substantially flat free-end lamellae extending outward is radially staggered from the substantially flat free-end lamellae extending inward with the substantially flat free-end lamellae defining cutting edges; and an annular internal cutting member configured to rotate around the central axis with respect to the external cutting member and having a cutting edge configured to cooperate during rotation with the cutting edges of the substantially flat free-end lamellae.

17. The shaving head as claimed in claim 16, wherein the external and internal cutting members are one of a plurality of external and internal cutting members and the two borders, when seen in a direction perpendicular to the central axis, are located at one side of the substantially flat free-end lamellae, which one side of the substantially flat free-end lamellae faces the internal cutting member.

* * * * *